US007572970B2

(12) United States Patent
Gouhara et al.

(10) Patent No.: US 7,572,970 B2
(45) Date of Patent: Aug. 11, 2009

(54) DIGITAL PIANO APPARATUS, METHOD FOR SYNTHESIS OF SOUND FIELDS FOR DIGITAL PIANO, AND COMPUTER-READABLE STORAGE MEDIUM

(75) Inventors: Takayuki Gouhara, Tokyo (JP); Shinichi Komori, Kanagawa (JP); Tomoe Ando, Kanagawa (JP)

(73) Assignee: Sony Corporation, Tokyo (JP)

( * ) Notice: Subject to any disclaimer, the term of this patent is extended or adjusted under 35 U.S.C. 154(b) by 59 days.

(21) Appl. No.: 11/760,193

(22) Filed: Jun. 8, 2007

(65) Prior Publication Data

US 2008/0006141 A1 Jan. 10, 2008

(30) Foreign Application Priority Data

Jun. 12, 2006 (JP) ..... 2006-162792

(51) Int. Cl.
*G10H 1/00* (2006.01)

(52) U.S. Cl. ..... 84/625; 84/626; 84/630; 84/660; 84/662

(58) Field of Classification Search ..... 84/625, 84/626, 630, 660, 662
See application file for complete search history.

(56) References Cited

U.S. PATENT DOCUMENTS 4,058,045 A * 11/1977 Jennings et al. ..... 84/731
5,262,586 A * 11/1993 Oba et al. ..... 84/723
5,338,892 A * 8/1994 Sekine et al. ..... 84/662
5,369,224 A * 11/1994 Miyata ..... 84/662
5,753,842 A * 5/1998 Kitamura ..... 84/604
5,784,467 A 7/1998 Asayama
5,789,693 A * 8/1998 Lawson ..... 84/744
5,822,438 A * 10/1998 Sekine et al. ..... 381/17
6,392,136 B2 * 5/2002 Kondo et al. ..... 84/718
6,828,497 B2 * 12/2004 Yataka et al. ..... 84/625
6,888,058 B2 * 5/2005 Urai et al. ..... 84/737
6,921,856 B2 * 7/2005 Koseki ..... 84/603
7,002,070 B2 * 2/2006 Katz ..... 84/718
7,332,669 B2 * 2/2008 Shadd ..... 84/742
2001/0052284 A1 * 12/2001 Kondo et al. ..... 84/718
2003/0015086 A1 * 1/2003 Katz ..... 84/644
2003/0121402 A1 * 7/2003 Yataka et al. ..... 84/625
2003/0126975 A1 * 7/2003 Urai et al. ..... 84/737

(Continued)

FOREIGN PATENT DOCUMENTS

JP 08-272380 10/1996

*Primary Examiner*—David S. Warren
(74) *Attorney, Agent, or Firm*—Finnegan, Henderson, Farabow, Garrett & Dunner, L.L.P.

(57) ABSTRACT

A digital piano apparatus includes an input unit including a plurality of keys and a plurality of pedals, a sound source unit, a sound field synthesizing unit, and a speaker unit. The sound field synthesizing unit includes virtual sound source spot signal generating means for generating a plurality of virtual sound source spot signals of a number equivalent to the number of output channels in the speaker unit, the plurality of virtual sound source spot signals being used for forming reproduced sound fields of a grand piano on the basis of a plurality of tone signals supplied from the sound source unit; mixing means for mixing each virtual sound source spot signal with the remaining virtual sound source spot signals; and sound effect means for applying a sound effect by signal processing using impulse responses to the virtual sound source spot signals.

13 Claims, 6 Drawing Sheets

U.S. PATENT DOCUMENTS

2003/0177886 A1* 9/2003 Koseki ..... 84/600
2003/0196539 A1* 10/2003 Koseki et al. ..... 84/604
2004/0025676 A1* 2/2004 Shadd ..... 84/743
2006/0000343 A1* 1/2006 Koseki et al. ..... 84/604
2006/0005691 A1* 1/2006 Koseki et al. ..... 84/604
2007/0079693 A1* 4/2007 Valli et al. ..... 84/723
2007/0084334 A1* 4/2007 Sato ..... 84/626

* cited by examiner

DIGITAL PIANO APPARATUS, METHOD FOR SYNTHESIS OF SOUND FIELDS FOR DIGITAL PIANO, AND COMPUTER-READABLE STORAGE MEDIUM

CROSS REFERENCES TO RELATED APPLICATIONS

The present invention contains subject matter related to Japanese Patent Application JP 2006-162792 filed in the Japanese Patent Office on Jun. 12, 2006, the entire contents of which are incorporated herein by reference.

BACKGROUND OF THE INVENTION

1. Field of the Invention

The present invention relates to a digital piano apparatus that mixes multiple tone signals corresponding to input signals from multiple keys and pedals to output a sound from speakers, a method for synthesis of sound fields for a digital piano, and a program for synthesis of sound fields for a digital piano.

2. Description of the Related Art

In a typical common stereo digital piano in related art, a sound image is reproduced so as to draw a semicircle upward from the ends of two speakers toward the midpoint of the two speakers. Accordingly, a listener of the stereo digital piano in the related art can listen to the reproduced stereo sound image well if he/she is located near the midpoint of the two speakers.

Digital piano systems are provided in which speakers serving as sound sources are physically arranged in piano-shaped (grand piano-shaped) cases. In such a digital piano system, since the speakers arranged in the piano-shaped (grand piano-shaped) case serve as sound sources, a listener of the digital piano system can listen to a sound image reproduced inside the case of the digital piano system well.

Methods of reproducing sounds in virtual three-dimensional spaces are also proposed. In such a sound reproducing method in a virtual three-dimensional space, multiple acoustic vectors are set, a virtual space is formed by the boundaries of a polygon, and propagation historical data concerning the acoustic vectors for a predetermined time duration in which sound waves that are reflected from the boundaries are propagated is calculated and stored.

In the sound reproducing method in a virtual three-dimensional space, transient responses reaching measurement points, which are small surface elements of the sound waves reflected from the boundaries and velocity potentials to the measurement points on the basis of the propagation historical data, the transient responses are added to numeric arrays in time series, and the added results are stored. Accordingly, the sound reproducing method in a virtual three-dimensional space can use an approximate boundary integral method to yield precise acoustic characteristics of a space including a wide frequency band in a relatively short time even with an inexpensive computer (refer to Japanese Unexamined Patent Application Publication No. H8-272380).

SUMMARY OF THE INVENTION

However, in the stereo digital piano in the related art, the listener can listen to the reproduced stereo sound image well only if he/she is located near the midpoint of the two speakers but the listener cannot listen to the reproduced stereo sound image well if he/she is located at a position between the ends of the two speakers and the midpoint thereof. Accordingly, it is not possible to localize the reproduced sound image so as to be lined up in the lateral direction while vertically maintaining a predetermined width.

In addition, in the stereo digital piano in the related art, the reproduced sound image has a lower lateral resolution and has a smaller amount of information, thus reducing a sense of realism. Furthermore, since the reproduced image has a smaller depth to provide a point or planar sound image to the listener, it is not possible to reproduce a stereoscopic sound image.

In the digital piano system in which the speakers are arranged in the piano-shaped (grand piano-shaped) case, it is necessary for the digital piano system to have the same size as that of the grand piano in order to acquire features of the grand piano. Accordingly, it is not possible to reduce the size of the digital piano system and, therefore, the position and size of the sound source are restricted.

In the sound reproducing method in a virtual three-dimensional space, a technology called a wave field synthesis (WFS) is used to describe another method having an effect similar to that of the WFS and to describe an effect achieved when the stereo system is realized by the WFS. Specifically, the acoustic characteristics of the sound fields are precisely reproduced by the approximate boundary integral method, which is an approximate calculation method allowing for the wave nature, by using Kirchhoff-Helmholtz integral equation as a basic theoretical formula and the reflected sounds are also yielded by this synthesis method.

However, since it is necessary to sequentially perform the calculation for digitizing the virtual space and the calculation by the approximate boundary integral method and, therefore, the calculation process becomes complicated, it is not possible to synthesize the virtual sound fields in real time. In addition, since hardware, such as the arrangement of the speakers, is determined after the virtual space is digitized and the transient responses are calculated in accordance with the hardware, there is a problem in that the setup of the hardware, such as the arrangement of the speakers, is fixed only after the transient responses are calculated.

It is desirable to provide a digital piano apparatus capable of localizing the reproduced sound images so as to be lined up in the lateral and depth direction while vertically maintaining a predetermined width, reproducing the stereoscopic sound images with an improved sense of realism, and synthesizing the virtual sound fields in real time because no restriction is imposed on the position and size of the sound source and there is no need for the sequential calculation. It is also desirable to provide a method for synthesis of sound fields for a digital piano and a program for synthesis of sound fields for a digital piano.

According to an embodiment of the present invention, a digital piano apparatus includes an input unit including a plurality of keys and a plurality of pedals; a sound source unit that outputs a plurality of tone signals corresponding to input signals supplied from the input unit; a sound field synthesizing unit that synthesizes the plurality of tone signals and outputs synthesized signals; and a speaker unit that outputs sound waves corresponding to the synthesized signals. The sound field synthesizing unit includes virtual sound source spot signal generating means for generating a plurality of virtual sound source spot signals of a number equivalent to the number of output channels in the speaker unit, the plurality of virtual sound source spot signals being used for forming reproduced sound fields of a grand piano on the basis of the plurality of tone signals supplied from the sound source unit; mixing means for mixing each virtual sound source spot signal with the remaining virtual sound source spot signals, among the plurality of virtual sound source spot signals of the number equivalent to the number of the output channels, output from the virtual sound source spot signal generating means; and sound effect means for applying a sound effect by signal processing using impulse responses to the virtual sound source spot signals of the number equivalent to the number of the output channels, mixed by the mixing means.

According to another embodiment of the present invention, there is provided a method for synthesis of sound fields for a digital piano that outputs a plurality of tone signals corresponding to input signals from a plurality of keys and a plurality of pedals, synthesizes the plurality of tones signals to generate synthesized outputs, and outputs sound waves corresponding to the synthesized outputs from speakers. The synthesis of the plurality of tone signals includes the steps of generating a plurality of virtual sound source spot signals of a number equivalent to the number of output channels of the speakers, the plurality of virtual sound source spot signals being used for forming reproduced sound fields of a grand piano on the basis of the plurality of tone signals; mixing each virtual sound source spot signal with the remaining virtual sound source spot signals, among the plurality of generated virtual sound source spot signals of the number equivalent to the number of the output channels; and applying a sound effect by signal processing using impulse responses to the mixed virtual sound source spot signals of the number equivalent to the number of the output channels.

According to another embodiment of the present invention, there is provided a program for synthesis of sound fields for a digital piano, causing a computer to output a plurality of tone signals corresponding to input signals from a plurality of keys and a plurality of pedals, to synthesize the plurality of tones signals to generate synthesized outputs, and to output sound waves corresponding to the synthesized outputs from speakers. The synthesis of the plurality of tone signals includes the steps of generating a plurality of virtual sound source spot signals of a number equivalent to the number of output channels of the speakers, the plurality of virtual sound source spot signals being used for forming reproduced sound fields of a grand piano on the basis of the plurality of tone signals; mixing each virtual sound source spot signal with the remaining virtual sound source spot signals, among the plurality of generated virtual sound source spot signals of the number equivalent to the number of the output channels; and applying a sound effect by signal processing using impulse responses to the mixed virtual sound source spot signals of the number equivalent to the number of the output channels.

The digital piano apparatus, the method for synthesis of sound fields for a digital piano, and the program for synthesis of sound fields for a digital piano according to the embodiments of the present invention can generate the plurality of virtual sound source spot signals used for forming the sound fields composed of the multiple piano synthetic sounds inside the piano case. The reproduction of the sound effect characteristics of the sound fields with the multiple virtual sound source spot signals allows the sound fields of the grand piano to be effectively synthesized.

In order to synthesize the sound fields of the grand piano, any effect of a room (the case of the piano), such as any reflected sound, is measured as the transfer characteristics of the real piano, the transfer characteristics are realized as the filtering process for the multiple virtual sound source spot signals, and the correction process depending on the WFS technology is effectively applied to the multiple virtual sound source spot signals as a sound effect.

According to the embodiments of the present invention, the generation of the multiple virtual sound source spot signals permits effective synthesis of the sound fields of the grand piano. Consequently, the reproduced sound images can be localized so as to be lined up in the lateral and depth directions while vertically maintaining a predetermined width as if a listener of the digital piano listened to the sound fields of the grand piano, thus reproducing stereoscopic sound images with an improved sense of realism.

This improved sense of realism and the sound fields produced by the reproduced sound images allows the player of the digital piano to feel the localization of the natural and spatial sound of the grand piano and to stereoscopically feel the localization of the sound images specific to the grand piano, the movement of the sound images, the propagation direction of the sound, and the manner in which the sound is fading. In addition, since the transfer characteristics used for adding the effect of the piano case to the supplied tone signals are realized as the filtering process for the multiple generated virtual sound source spot signals, it is possible to generate a stereoscopic reflected sound to allow the listener of the digital piano to stereoscopically feel the presence of the grand piano.

Since the multiple virtual sound source spot signals are generated at the virtual sound source spots and, therefore, the digital piano includes only the sound source unit and the sound field synthesizing unit composed of the computer and the programs, in addition to the keys, the pedals, and the multiple speaker, no restriction is imposed on the position and size of the sound source. Consequently, there is no need for the digital piano to have a large space, unlike the real grand piano, and it is possible to realize the digital piano having the size of the normal digital piano in related art even if the digital piano functionally has a size that physically does not exist. Increasing the number of the speakers and improving the computing power of, for example, the filtering process in the computer can improve a sense of realism, the resolution of the right and left sound images, and the reproducibility of the reflected sound.

Furthermore, any effect of the case of the piano is measured as the transfer characteristics of the real piano, the transfer characteristics are realized as the filtering process for the multiple virtual sound source spot signals, and the correction process depending on the WFS technology is effectively applied to the multiple virtual sound source spot signals as the sound effect. Accordingly, it is not necessary to perform sequence calculations by using complicated numeric expressions and, therefore, the virtual sound fields can be synthesized in real time.

DESCRIPTION OF THE PREFERRED EMBODIMENTS

Embodiments of the present invention will now be described with reference to the attached drawings.

Figure 1:
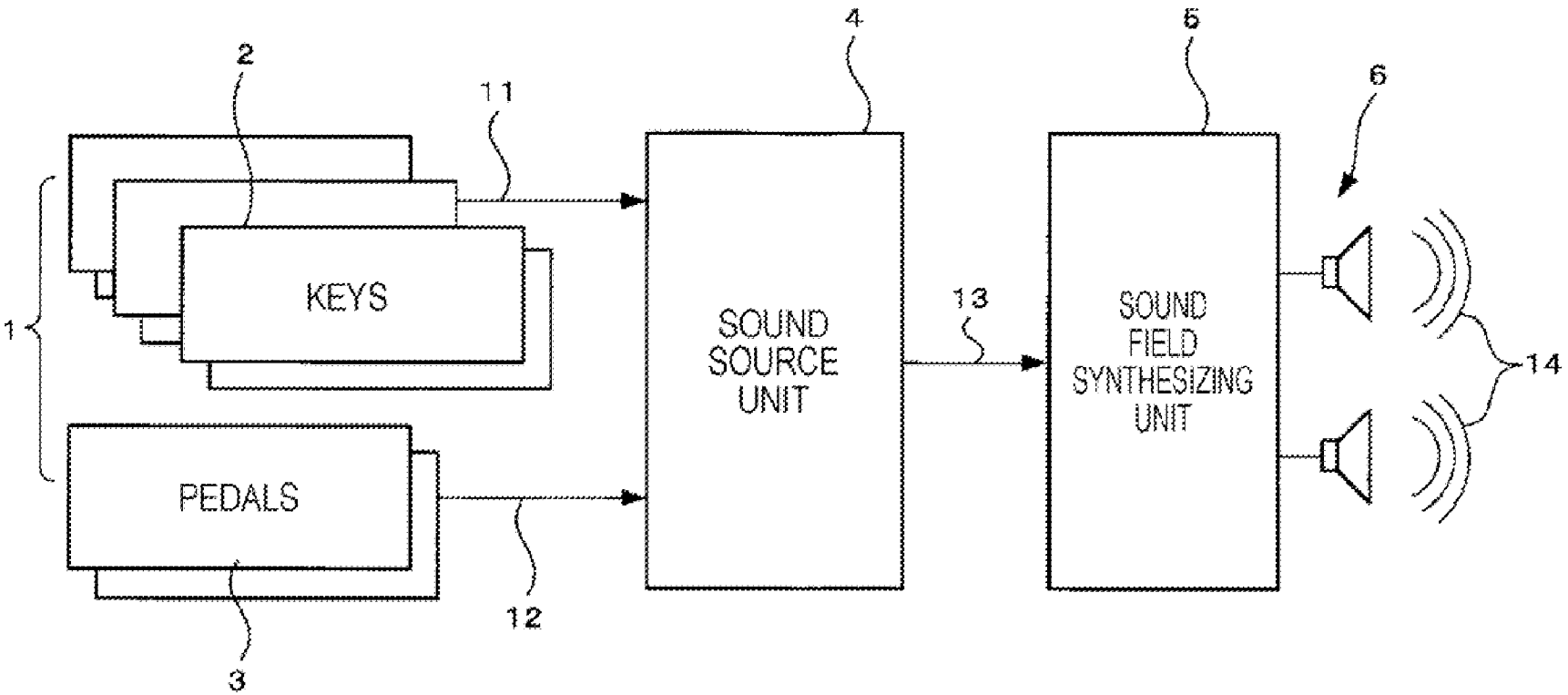
FIG. 1 is a block diagram showing an example of the configuration of a digital piano according to an embodiment of the present invention.

A function of synthesizing sound fields according to an embodiment of the present invention is applied to a sound field synthesizing unit (signal reproduction) that synthesizes sound fields of a digital piano. FIG. 1 is a block diagram showing an example of the configuration of a digital piano.

Referring to FIG. 1, the digital piano includes an input unit 1 (including keys 2 and pedals 3), a sound source unit 4, a sound field synthesizing unit 5, and a speaker unit 6. Each key signal 11 (not number and speed) and each pedal signal 12 (speed) detected by the input unit 1 (the keys 2 and the pedals 3) are supplied to the sound source unit 4. The sound source unit 4 converts the value (the kind and speed of a note corresponding to the note number) of the key signal 11 (note number and speed) and the value (the speed of a note corresponding to the note number) of the pedal signal 12 (speed) into tone signals 13 indicating data concerning the notes.

The tone signals 13 are synthesized by the sound field synthesizing unit 5 to generate multiple virtual sound source spot signals used for forming sound fields composed of multiple piano synthetic sounds inside the case of the digital piano. The speaker unit 6 outputs the multiple virtual sound source spot signals as sound waves 14, which are aerial vibrations.

Figure 2:
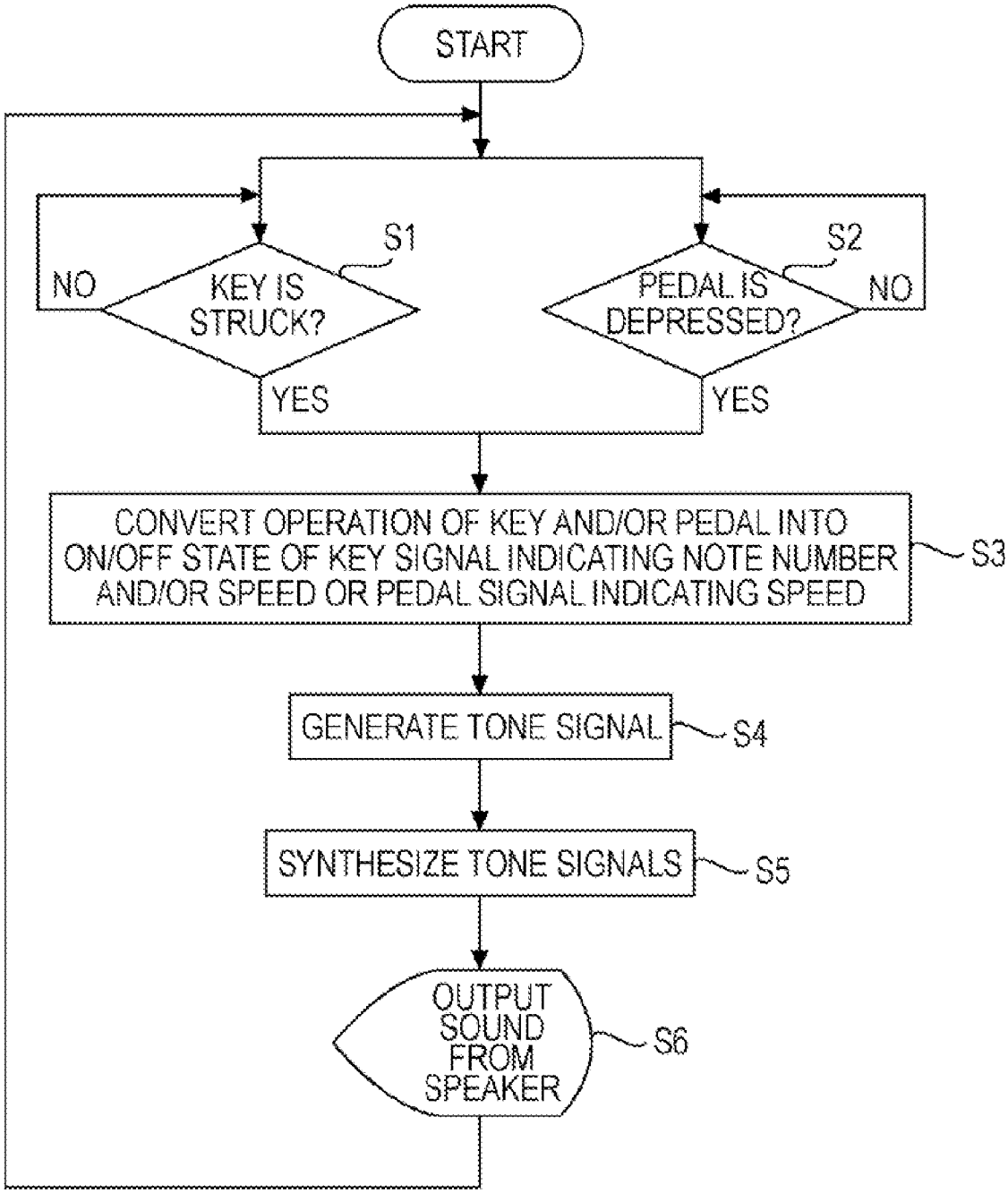
FIG. 2 is a flowchart showing an example of the operation of the digital piano shown in FIG. 1.

FIG. 2 is a flowchart showing an example of the operation of the digital piano shown in FIG. 1. The operation shown in FIG. 2 is performed by a computer (not shown) serving as a control unit of the digital piano.

Referring to FIG. 2, in Step S1, the computer determines whether any of the keys 2 in the input unit 1 shown in FIG. 1 is struck. In Step S2, the computer determines whether any of the pedals 3 is depressed.

If the computer determines in Step S1 that any of the keys 2 is struck or determines in Step S2 that any of the pedals 3 is depressed, then in Step S3, the key 2 converts the operation of the key 2 into an on or off state of the key signal 11 (note number and speed) or the pedal 3 converts the operation of the pedal 3 into an on or off state of the pedal signal 12 (speed).

In Step S4, the sound source unit 4 in FIG. 1 converts the value (the kind and speed of a note corresponding to the note number) of the key signal 11 (note number and speed) converted by the key 2 and/or the value (the speed of a note corresponding to the note number) of the pedal signal 12 (speed) converted by the pedal 3 into the tone signals 13 indicating data concerning the notes to generate the tone signals 13.

In Step S5, the sound field synthesizing unit 5 in FIG. 1 synthesizes the multiple generated tone signals 13. At this time, the multiple virtual sound source spot signals are generated to form sound fields composed of the multiple piano synthetic sounds inside the case of the digital piano. In Step S6, the speaker unit 6 in FIG. 1 outputs the multiple virtual sound source spot signals as the sound waves 14, which are aerial vibrations.

Figure 3:
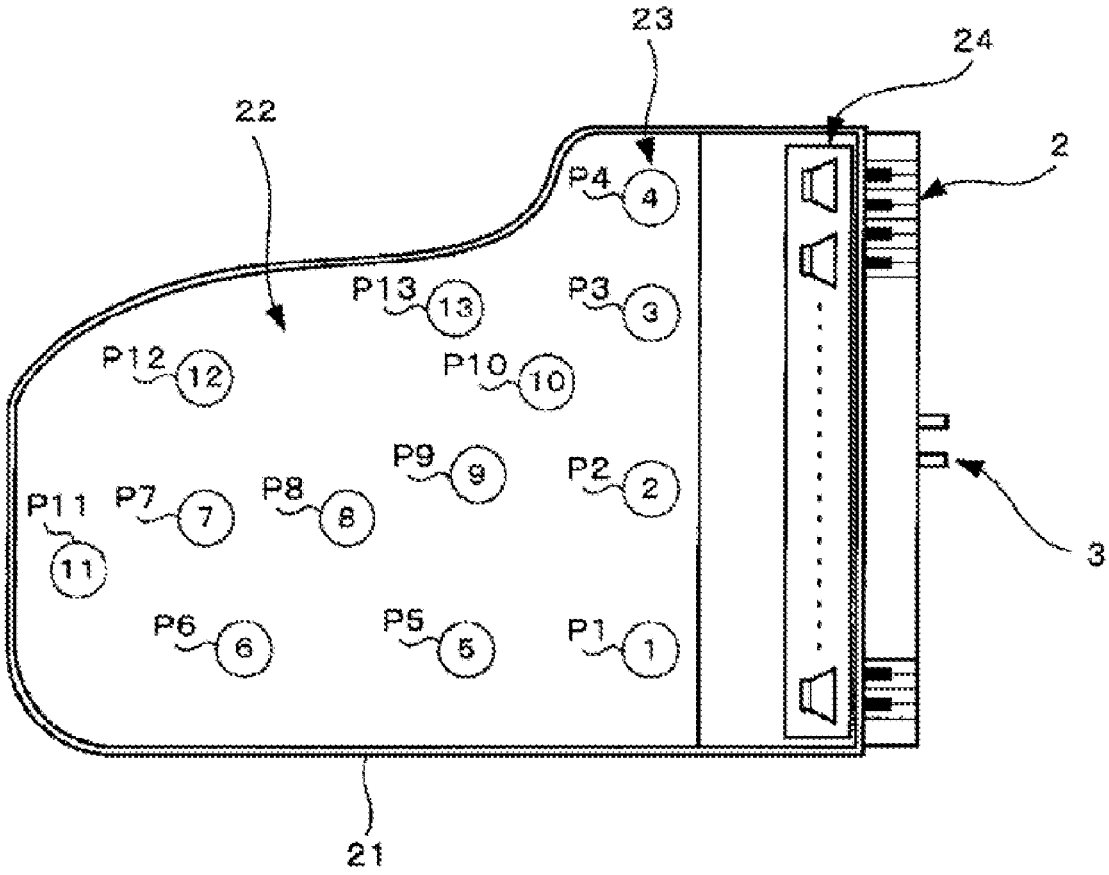
FIG. 3 illustrates an example of a sound production model in a virtual grand piano, produced by a wave field synthesis (WFS) technology, according to an embodiment of the present invention.

FIG. 3 illustrates an example of a sound production model in a virtual grand piano, produced by the wave field synthesis (WFS) technology.

Referring to FIG. 3, the multiple virtual sound source spot signals are generated by the sound field synthesizing unit 5 in FIG. 1 so as to reproduce real sound source spot signals recorded by multiple microphones. The multiple microphones are arranged in advance at spots P1 to P13 among multiple virtual sound source spots 23 in a virtual sound source area 22 inside a virtual piano case 21 of the virtual grand piano shown in FIG. 3. The spots P1 to P13 in the virtual sound source spots 23 form the sound production model of the virtual grand piano, which correspond to reproduced sound fields of the grand piano.

The real digital piano apparatus includes only a speaker array 24 corresponding to the speaker unit 6 in FIG. 1, the keys 2, and the pedals 3. The virtual piano case 21, the virtual sound source area 22, and the spots P1 to P13 in the multiple virtual sound source spots 23 do not actually exist but indicate that the reproduced sound fields are virtually localized at the spots P1 to P13.

Among the multiple virtual sound source spots 23 in the virtual sound source area 22 inside the virtual piano case 21 of the virtual grand piano shown in FIG. 3, the spots P1 (low note) to P4 (high note) denote relatively proximal positions of strings and the spots P5 and P6 denote middle positions of the string corresponding to the spot P1 (low note). The spots P7 and P8 denote distal and middle positions of the string corresponding to the spot P2 (medium low note). The spots P9 and P10 denote middle positions of strings between the spots P2 and P3 (medium low note). The spot P11 denotes a relatively distal position of a string between the spots P1 (low note) and P2 (medium low note), the spot P12 denotes a relatively distal position of a string between the spots P2 (medium low note) and P3 (medium low note), and the spot P13 denotes a relatively distal position of the string corresponding to the spot P3 (medium low note).

The wave field synthesis (WFS) described below is a technology of synthesizing the wavefronts produced by sounds generated by an arbitrary point sound source by controlling sounds generated by myriad other sound sources. The spots on the virtual piano case 21 shown in FIG. 3 correspond to virtual sound sources in the WFS and the speakers in the speaker array 24 correspond to real sound sources controlling real sounds. According to the embodiment the present invention, the virtual sound source spots 23 are defined on the virtual piano case 21 and are arranged at the positions P1 to P13, a sound effect is made by performing correction processing in the WFS to the virtual sound source spot signals at the virtual sound source spots 23 synthesized by the WFS technology described below, and the sounds are reproduced by the speaker array 24 to synthesize the sound fields produced by the grand piano. As a result, it is possible to realize sound images that have a sense of realism and that dynamically move, as in the real grand piano.

Figure 4:
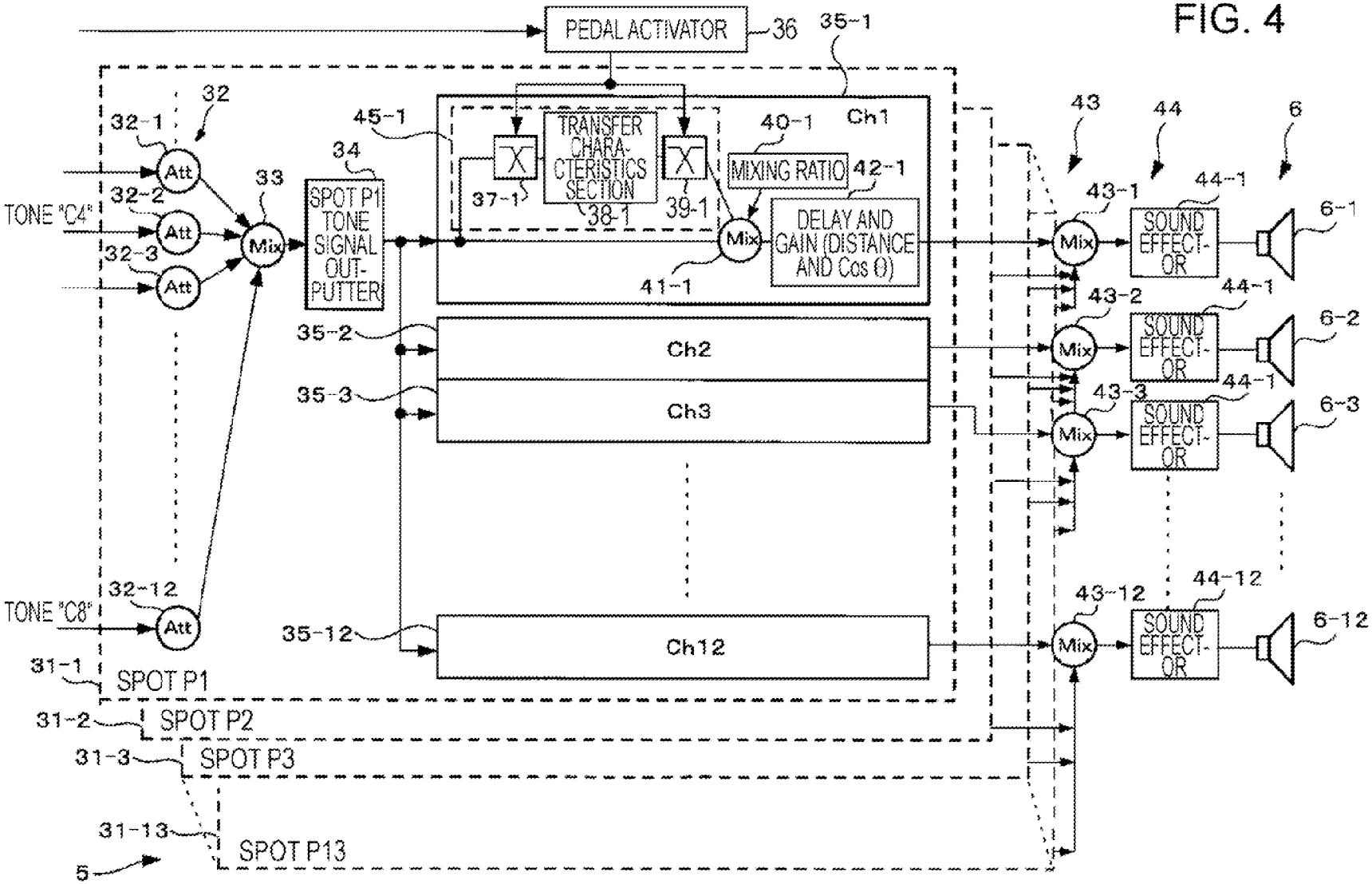
FIG. 4 is a block diagram showing an example of the configuration of sound field synthesizing unit according to an embodiment of the present invention.

FIG. 4 is a block diagram showing an example of the configuration of the sound field synthesizing unit 5 shown in FIG. 1. The sound field synthesizing unit 5 includes a computer and programs controlling the operation of the computer to cause each component to carry out the following functions.

Referring to FIG. 4, the sound field synthesizing unit 5 generates the virtual sound source spot signals at the virtual sound source spots P1 to P13. Virtual sound source spot signal generators 31-1 to 31-13 at the virtual sound source spots P1 to P13, in the sound field synthesizing unit 5, generate the virtual sound source spot signals of a number equivalent to the number of output channels (1 to 12) of the speaker unit 6. The virtual sound source spot signals are used for forming reproduced sound fields of the grand piano on the basis of the multiple tone signals supplied from the sound source unit 4.

The virtual sound source spot signal generator 31-1 at the virtual sound source spot P1 will now be described. The virtual sound source spot signal generators 31-2 to 31-13 at the remaining virtual sound source spots P2 to P13 have the same configuration as that of the virtual sound source spot signal generator 31-1.

The virtual sound source spot signal generator 31-1 at the virtual sound source spot P1 includes attenuators 32 (32-1 to 32-12), a mixer 33, a spot P1 tone signal outputter 34, and channel 1 processor 35-1 to channel 12 processor 35-12. The attenuators 32 (32-1 to 32-12) attenuate the multiple tone signals corresponding to the virtual sound source spot P1, supplied from the sound source unit 4 in FIG. 1, to a level in which signal processing is enabled. The mixer 33 mixes the outputs from the attenuators 32 attenuating the multiple tone signals corresponding to the virtual sound source spot P1. The spot P1 tone signal outputter 34 outputs the output from the mixer 33 as tone signals corresponding to the virtual sound source spot P1.

The multiple tone signals corresponding to the virtual sound source spot P1 have tone names, for example, C4 to C8.

The channel 1 processor 35-1 includes a delay section 42-1 and a transfer characteristics section 38-1. The delay section 42-1 calculates distances and angles between the virtual sound source spot P1 and speakers 6-1 to 6-12 corresponding to the output channels 1 to 12 in the speaker unit 6 to delay the supplied tone signals on the basis of the calculation result. The transfer characteristics section 38-1 measures resonation and reflection characteristics of the strings inside the virtual piano case 21 of the grand piano as transfer characteristics between the virtual sound source spot P1 and the speakers 6-1 to 6-12 corresponding to the output channels 1 to 12 in the speaker unit 6 to filter the transfer characteristics of the supplied tone signals on the basis of the measurement result.

The channel 1 processor 35-1 also includes a mixing section 41-1. The mixing section 41-1 mixes the output from the transfer characteristics section 38-1 with the input into the delay section 42-1 at a predetermined mixture ration. The mixing section 41-1 has a function of setting the mixture ratio as if sounds corresponding to the virtual sound source spot P1 were output from the virtual sound source spot P1 when a listener of the digital piano listens to the sounds output from the speaker unit 6.

The channel 1 processor 35-1 further includes a gain section 42-1. The gain section 42-1 calculates distances and angles between the virtual sound source spot P1 and the speakers 6-1 to 6-12 corresponding to the output channels 1 to 12 in the speaker unit 6 to apply gains to the supplied tone signals on the basis of the calculation result. The gain section 42-1 has a function of controlling the gains of the virtual sound source spot signals at the virtual sound source spot P1 to localize the sound image at the virtual sound source spot P1.

The channel 1 processor 35-1 further includes an input fader 37-1 and an output fader 39-1. A pedal processor 45-1 includes the input fader 37-1, the transfer characteristics section 38-1, and the output fader 39-1. The input fader 37-1 attenuates or amplifies the signal supplied to the transfer characteristics section 38-1 in accordance with a variation in a pedal value supplied from the a pedal activator 36. The output fader 39-1 attenuates or amplifies the signal supplied from the transfer characteristics section 38-1 in accordance with a variation in the pedal value supplied from the pedal activator 36. The input fader 37-1 and the output fader 39-1 have a function of applying a pedal effect caused by a variation in the pedal value to the virtual sound source spot signals at the virtual sound source spot P1.

The sound field synthesizing unit 5 includes mixers 43 (43-1 to 43-12). The mixers 43 (43-1 to 43-12) mixes each virtual sound source spot signal with the remaining virtual sound source spot signals, among the multiple virtual sound source spot signals output from the channel 1 processor 35-1 to the channel 12 processor 35-12 in the virtual sound source spot signal generators 31-1 to 31-13 at the virtual sound source spots P1 to P13.

Specifically, the mixer 43-1 mixes the P1 virtual sound source spot signal output from the channel 1 processor 35-1 at in the virtual sound source spot signal generator 31-1 at the virtual sound source spot P1 with the P2 to P13 virtual sound source spot signals output from the channel 1 processors in the virtual sound source spot signal generators 31-2 to the 31-13 at the remaining virtual sound source spots P2 to P13.

The mixer 43-2 mixes the P1 virtual sound source spot signal output from the channel 2 processor 35-2 in the virtual sound source spot signal generator 31-1 at the virtual sound source spot P1 with the P2 to P13 virtual sound source spot signals output from the channel 2 processors in the virtual sound source spot signal generators 31-2 to the 31-13 at the remaining virtual sound source spots P2 to P13.

The mixer 43-3 mixes the P1 virtual sound source spot signal output from the channel 3 processor 35-3 in the virtual sound source spot signal generator 31-1 at the virtual sound source spot P1 with the P2 to P13 virtual sound source spot signals output from the channel 3 processors in the virtual sound source spot signal generators 31-2 to the 31-13 at the remaining virtual sound source spots P2 to P13.

Similarly, the mixer 43-12 mixes the P1 virtual sound source spot signal output from the channel 12 processor 35-12 in the virtual sound source spot signal generator 31-1 at the virtual sound source spot P1 with the P2 to P13 virtual sound source spot signals output from the channel 12 processors in the virtual sound source spot signal generators 31-2 to the 31-13 at the remaining virtual sound source spots P2 to P13.

The sound field synthesizing unit 5 also includes sound effectors 44 (44-1 to 44-12). The sound effectors 44-1 to 44-12 apply sound effects by signal processing using impulse responses to the virtual sound source spot signals at the virtual sound source spots P1 to P13, which correspond to the output channels 1 to 12 and which are mixed by the mixers 43-1 top 43-12.

The sound effectors 44-1 to 44-12 use, for example, linear convolution filters to perform the correction processing in the WFS (perform amplification at a level of 3 dB per one octave (3 dB/oct)). Performing the correction processing, which is part of the WFS, at a high speed in the sound effect processing in the final output stage allows the correction processing to be performed independently of, for example, the number of the point sound sources at the virtual sound source spots P1 to P13 where the synthesis has been performed.

The sound effectors 44-1 to 44-12 have a function of applying the sound effects so that reproduced sound fields of a grand piano are formed in a certain room or acoustic hall by the signal processing using the impulse responses. Such sound effects are made by setting microphones in the room or hall to record real sounds and reproducing the real sounds.

The virtual sound source spot signal generators 31-1 to 31-13 are provided at the virtual sound source spots P1 to P13, respectively, defined in the sound production model of the virtual grand piano shown in FIG. 3. The virtual sound source spot signals that are generated from the tone signals supplied from the sound source unit 4 and that are synthesized by the WFS technology are subjected to the sound effects through the correction processing in the WFS and are output from the speakers on the speaker array. Accordingly, the listener of the digital piano can listen to the input signals as if the input signals were generated at the virtual sound source spots P1 to P13.

Specifically, the virtual sound source spot signal generators 31-1 to 31-13 each calculate distances and angles between the virtual sound source spots and the speakers on the speaker array, add delays and gains (attenuation value) yielded from the calculation result to the signals, and mix the signals of the number equivalent to the number of channels of the speakers. In order to add effects of the reflection from the strings and the case of the digital piano and effects of the resonation of the strings caused by the pedals to the signals, the transfer characteristics between the virtual sound source spots and the speakers are measured and the measured transfer characteristics are applied as the filters of transfer functions. The signals subjected to the filtering processing are added to the input signals at a predetermined mixture ratio and the signals at the virtual sound source spots P1 to P13 are synthesized by the WFS. Then, the sound effects are applied to the signals through the correction processing in the WFS and the signals to which the sound effects are applied are supplied to the speakers.

Figure 5:
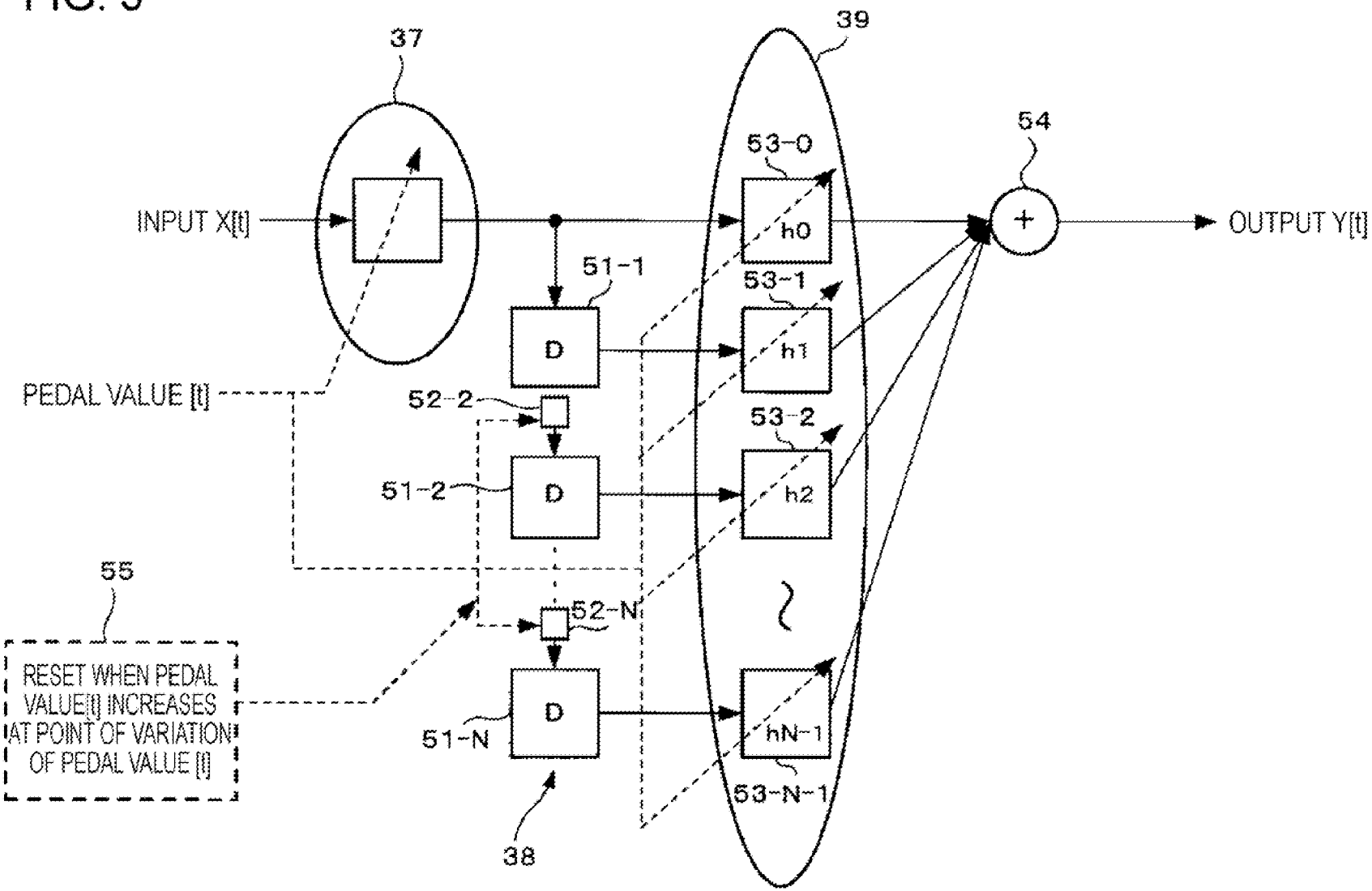
FIG. 5 illustrates the function of a pedal processor according to an embodiment of the present invention.

The function of the pedal processor will now be described with reference to FIG. 5. FIG. 5 shows an example of the configuration of the pedal processor 45-1 in detail.

Referring to FIG. 5, the pedal processor includes the input fader 37, the output fader 39, and memories 52-2 to 52-N. The input fader 37 attenuates or amplifies an input signal X[t] supplied to the transfer characteristics section 38 in accordance with a variation in a pedal value [t] supplied from the pedal activator 36. The output fader 39 attenuates or amplifies an output signal Y[t] supplied from the transfer characteristics section 38 in accordance with a variation in the pedal value [t] supplied from the pedal activator 36. The memories 52-2 to 52-N stores reset transfer characteristics used for resetting transfer functions 51-2 to 51-N in the transfer characteristics section 38 if the pedal value [t] increases at a point of variation of the pedal value [t]. The pedal processor has a function of applying the pedal effect caused by a variation in the pedal value [t] to the virtual sound source spot signals at the virtual sound source spots P1 to P13.

Specifically, as shown in a box 55 drawn by a dotted line, if a point where the pedal value [t] supplied from the pedal activator 36 varies is detected and the pedal value [t] increases at the point of variation, the reset transfer characteristics stored in the memories 52-2 to 52-N are used to reset the transfer functions 51-2 to 51-N in the transfer characteristics section 38. In the initial state, the transfer functions in a normal transfer state are set as the transfer functions 51-2 to 51-N in the transfer characteristics section 38. The transfer functions in the normal transfer state are set such that the output level due to a sound vibration is maximized when the sound is output, is gradually attenuated, and is minimized.

However, if a pedal operation is detected, it is necessary to set the transfer functions in a transfer state in which the pedal effect is applied so as to keep the output level due to the sound vibration at a level between the maximum level and the minimum level at the time when the pedal operation is detected without attenuation. Accordingly, the pedal effect is applied by using the transfer functions in the transfer state having the reset transfer characteristics of which the level at the time when the pedal operation is detected is kept without attenuation. A long time during which the level is gradually attenuated can be set for the reset transfer characteristics stored in the memories 52-2 to 52-N to enhance the pedal effect, along with the fader effect of fader portions 53-0 to 53-N-1 in the output fader 39.

The outputs from the fader portions 53-0 to 53-N-1 in the output fader 39 are added to each other by an adder 54 and the addition result is output as the output signal Y[t].

Figure 6:
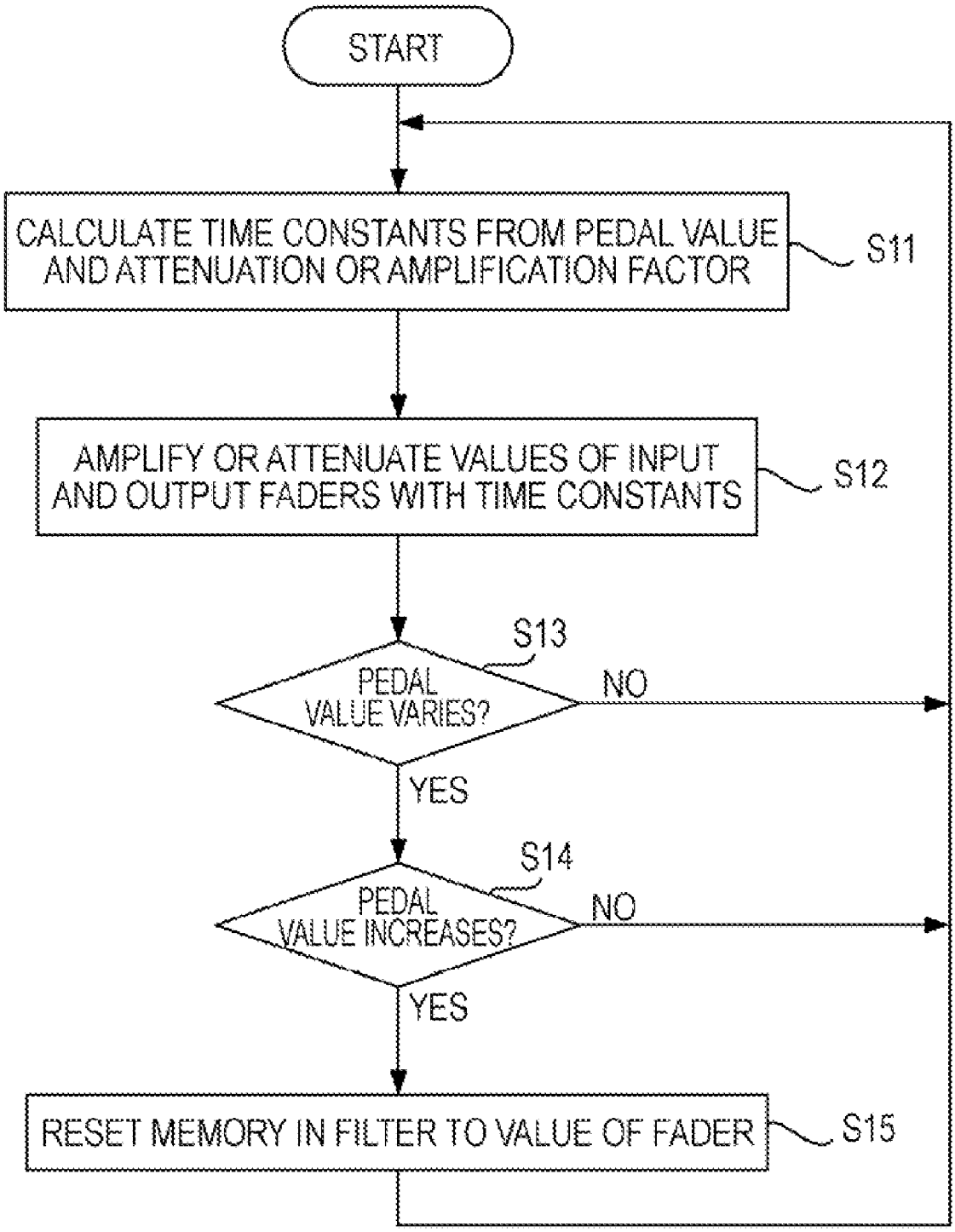
FIG. 6 is a flowchart showing an example of the operation of the pedal processor shown in FIG. 5.

FIG. 6 is a flowchart showing an example of the operation of the pedal processor shown in FIG. 5.

Referring to FIG. 6, in Step S11, the pedal processor calculates time constants from the pedal value and the attenuation or amplification factor. Specifically, the pedal processor calculates a time constant for the input fader 37 attenuating or amplifying the input signal X[t] in accordance with a variation in the pedal value [t] and a time constant for the output fader 39 attenuating or amplifying the output signal Y[t] in accordance with a variation in the pedal value [t], In step S12, the pedal processor attenuates or amplifies the values of the input fader and the output fader with the time constants. Specifically, the pedal processor attenuates or amplifies the input signal X[t] in the input fader 37 and the output signal Y[t] in the output fader 39 on the basis of the time constants for the input fader 37 and the output fader 39 calculated in Step S11.

In Step S13, the pedal processor determines whether the pedal value varies. Specifically, the pedal processor detects a point of variation by detecting a difference between times before and after the pedal value [t].

If the pedal processor determines in Step S13 that the pedal value varies, then in Step S14, the pedal processor determines whether the pedal value increases. Specifically, the pedal processor detects whether the pedal value [t] increases by detecting whether the differentiation of the pedal value [t] results in a positive value.

If the pedal processor determines in Step S14 that the pedal value increases, then in Step S15, the pedal processor resets the memory in the filter to a value of the corresponding fader. Specifically, the pedal processor uses the reset transfer characteristics stored in the memories 52-2 to 52-N to rest the transfer functions 51-2 to 51-N in the transfer characteristics section 38.

If the pedal processor determines in Step S13 that the pedal value does not vary, if the pedal processor determines in Step S14 that the pedal value does not increase, and after the resetting in Step S15, the pedal processor goes back to Step S11 to repeat the above steps.

In order to achieve the pedal effect, the input fader 37 and the output fader 39, which performs the attenuation or amplification in accordance with the pedal value, are provided at the input side and the output side, respectively, of the transfer characteristics section 38 serving as the filter to adjust the level of the resonation of the string varied in accordance with the pedal operation. Adding different pieces of spatial information to the multiple speakers with the above functions can achieve a reverberation effect having a spatial resolution higher than that of a normal stereo system.

According to the embodiments of the present invention, real sounds in an actual grand piano are recorded by the microphones at the virtual sound source spots P1 to P13 as the signals generated by the sound source, and the virtual sound source spot signals are generated by the sound field synthesizing unit 5 so as to reproduce the recorded real sounds. Recording the real sounds of the grand piano at the virtual sound source spots and generating the virtual sound source spot signals so as to reproduce the recorded real sounds allow information that slightly varies depending on the positions to be added to the sounds, whereby synthesizing spatial sounds as in the actual grand piano.

In addition, since the input gain of each virtual sound source spot is controlled for every tone and each tone is localized, it is possible to realize the localization of the actual grand piano. Furthermore, in the digital piano apparatus according to the embodiments of the present invention, the correction of the speakers and the correction based on the WFS technology are performed and the effect of providing a sense of realism in a room or hall is applied before the virtual sound source spot signals are fed to the speakers. Accordingly, it is possible to realize the sound effect of a real grand piano, which is natural for the player.

It should be understood by those skilled in the art that various modifications, combinations, sub-combinations and alterations may occur depending on design requirements and other factors insofar as they are within the scope of the appended claims or the equivalents thereof.

What is claimed is:

1. A digital piano apparatus, comprising:

an input unit including keys and pedals;

a sound source unit that outputs tone signals corresponding to input signals supplied from the input unit;

a sound field synthesizing unit that synthesizes the tone signals and outputs the synthesized tone signals;

a speaker unit that outputs sound waves corresponding to the synthesized tone signals on different output channels; and speakers connected to the output channels that reproduce the sound waves, wherein the sound field synthesizing unit includes:

means for generating virtual sound source location signals of a number equal to the number of output channels to reproduce a sound field for the digital piano based on the tone signals, the virtual sound source location signals corresponding to sounds of a reference piano from different locations about the reference piano, the means for generating virtual sound source location signals including delay means for calculating distances and angles between the locations and the speakers, and for delaying the tone signals based on the calculated distances and angles;

means for mixing the virtual sound source location signals; and means for applying a sound effect, by signal processing using impulse responses, to the mixed sound source location signals.

2. The digital piano apparatus according to claim 1, wherein:

the means for generating virtual sound source signals further includes filtering means for measuring resonation and reflection characteristics of strings of the reference piano between the locations and the speakers, and for filtering the tone signals based on the measured resonation and reflection characteristics.

3. The digital piano apparatus according to claim 2, wherein:

the means for generating virtual sound source location signals further includes means for mixing the filtered tone signals with an input to the delay means at a mixing ratio, and the mixing ratio is set such that the sounds of the reference piano from the different locations about the reference piano correspond to sounds output from the speaker unit as heard by a listener of the digital piano apparatus.

4. The digital piano apparatus according to claim 2, wherein:

the means for generating virtual sound source location signals further includes gain means for applying gains to the tone signals based on the calculated distances and angles, and the gains are controlled to localize sound images at the locations.

5. The digital piano apparatus according to claim 2, wherein the means for generating virtual sound source location signals further includes:

an input fader that attenuates or amplifies the tone signals, prior to filtering, in accordance with a variation in a pedal value;

an output fader that attenuates or amplifies the filtered tone signals in accordance with the variation in the pedal value; and a memory that stores transfer characteristics used for setting the filtering means if the pedal value increases, and wherein a pedal effect caused by the variation in the pedal value is applied to the virtual sound source location signals.

6. The digital piano apparatus according to claim 1, wherein the means for applying a sound effect applies the sound effect so that the reproduced sound for the digital piano corresponds to a room or an acoustic hall.

7. A method for synthesizing a sound field for a digital piano, comprising:

receiving tone signals corresponding to input signals from keys and from pedals;

synthesizing the tone signals; and outputting sound waves corresponding to the synthesized tone signals to speakers via output channels, the synthesizing including:

generating virtual sound source location signals of a number equal to the number of output channels to reproduce the sound field based on the tone signals, the virtual sound source location signals corresponding to sounds of a reference piano from different locations about the reference piano, the generating of the virtual sound source locations signals including calculating distances and angles between the locations and the speakers, and delaying the tone signals based on the calculated distances and angles;

mixing the virtual sound source location signals; and applying a sound effect, by signal processing using impulse responses, to the mixed virtual sound source location signals.

8. The method according to claim 7, wherein generating the virtual sound source location signals further includes:

measuring resonation and reflection characteristics of strings of the reference piano between the locations and speakers; and filtering the tone signals based on the measured resonation and reflection characteristics.

9. The method according to claim 8, wherein:

generating the virtual sound source location signals includes:

attenuating or amplifying the tone signals, prior to filtering, in accordance with a variation in a pedal value;

setting transfer characteristics used to filter the tone signals if the pedal value increases; and attenuating or amplifying the filtered tone signals in accordance with the variation in the pedal value, and the method further includes applying a pedal effect to the sound source location signals in accordance with the variation in the pedal value.

10. A computer-readable medium storing a program which, when executed by a computer, causes the computer to perform a method for synthesizing a sound field for a digital piano, the method comprising:

receiving tone signals corresponding to input signals from keys and from pedals;

synthesizing the tone signals outputting sound waves corresponding to the synthesized tone signals to speakers on different output channels, the synthesizing including:

generating virtual sound source location signals of a number equal to the number of output channels to reproduce the sound field of the digital piano based on tone signals, the virtual sound source location signals corresponding to sounds of a reference piano at different locations about the reference piano, the generating of the virtual sound source location signals including calculating distances and angles between the locations and the speakers, and delaying the tone signals based on the calculated distances and angles;

mixing virtual sound source location signals; and applying a sound effect, by signal processing using impulse responses, to the mixed virtual sound source location signals.

11. The computer-readable storage medium according to claim 10, wherein the generation of the virtual sound source location signals further includes:

measuring resonation and reflection characteristics of strings of the reference piano between the locations and the speakers based on the basis the measured resonation and reflection characteristics.

12. The computer-readable storage medium according to claim 11, wherein:

the generation of the virtual sound source location signals further includes:

attenuating or amplifying the tone signals, prior to filtering, in accordance with a variation in a pedal value;

setting transfer characteristics used to filter the tone signals if the pedal value increases; and attenuating or amplifying the filtered tone signals in accordance with the variation in the pedal value, and the method further includes applying a pedal effect to the virtual sound source location signals in accordance with the variation in the pedal value.

13. A digital piano apparatus, comprising:

an input unit including keys and pedals;

a sound source unit that outputs tone signals corresponding to input signals supplied from the input unit;

a sound field synthesizing unit that synthesizes the tone signals and outputs the synthesized tone signals;

a speaker unit that outputs sound waves corresponding to the synthesized tone signals on different output channels;

speakers connected to the output channels that reproduce the sound waves, wherein the sound field synthesizing unit includes:

a virtual sound source location signal generating unit that generates virtual sound source signals of a number equal to the number of output channels to reproduce a sound for the digital piano based on the tone signals, the virtual sound source location signals corresponding to sounds of a reference piano at different locations about the reference piano, the virtual sound source location signal generating unit including a filter that measures resonation and reflection characteristics of strings of a reference piano between the locations and the speakers, and that filters the tone signals based on the measured resonation and reflection characteristics;

a mixer that mixes virtual sound source signals; and a sound effect unit that applies a sound effect, by signal processing using impulse responses, to the mixed sound source location signals.

* * * * *